United States Patent [19]

Nakagawa et al.

[11] 3,936,516

[45] Feb. 3, 1976

[54] CARBURETOR HAVING AN ALTITUDE-EFFECTS COMPENSATION MECHANISM AND A METHOD FOR THE MANUFACTURE OF SAME

[75] Inventors: Toru Nakagawa, Mito; Takashi Mihashi, Yokohama, both of Japan

[73] Assignees: Hitachi, Ltd.; Nissan Motor Co., Ltd., both of Japan

[22] Filed: Nov. 23, 1973

[21] Appl. No.: 418,172

[30] Foreign Application Priority Data

Nov. 27, 1972 Japan ..... 47-118727

[52] U.S. Cl. ..... 261/39 A; 261/121 B

[51] Int. Cl.[2] ..... F02M 7/20

[58] Field of Search ..... 261/39 A, 121 B

[56] References Cited

UNITED STATES PATENTS

| | | | |
|---|---|---|---|
| 1,142,824 | 6/1915 | Lund | 261/39 A |
| 1,906,554 | 5/1933 | Dodds | 261/39 A |
| 1,973,162 | 9/1934 | Briggs | 261/39 D |
| 2,387,676 | 10/1945 | Phillips | 261/39 A |
| 3,011,770 | 12/1961 | Stoltman | 261/39 A |
| 3,271,014 | 9/1966 | Wu | 261/39 A |

FOREIGN PATENTS OR APPLICATIONS

| | | | |
|---|---|---|---|
| 327,157 | 10/1935 | Italy | 261/39 A |
| 465,505 | 5/1937 | United Kingdom | 261/39 A |

*Primary Examiner*—Tim R. Miles

*Attorney, Agent, or Firm*—Craig & Antonelli

[57] ABSTRACT

A carburetor having an altitude effects compensation mechanism comprising means disposed in the fuel passage from the float chamber of the carburetor to the Venturi for limiting the rate of fuel flow, a bellows adapted to be displaced by responding to changes in atmospheric pressure, and means for transmitting a displacement of the bellows to the limiting means. The bellows is immersed in the fuel in the float chamber.

7 Claims, 6 Drawing Figures

CARBURETOR HAVING AN ALTITUDE-EFFECTS COMPENSATION MECHANISM AND A METHOD FOR THE MANUFACTURE OF SAME

This invention relates to altitude effects compensation mechanisms adapted for use with carburetors for supplying a fuel-air mixture to internal combustion engines, and more particularly it is concerned with an altitude effects compensation mechanism adapted for use with a carburetor for a motor vehicle and a method for manufacturing the same.

Attempts have been made to restrict the noxious components of exhausts from motor vehicle engines. There is no doubt that this tendency will be increased more and more in the future.

There are several methods available for rendering noxious components of exhausts innocuous. Attention has been attracted to exhaust emission control devices whereby air is blown into the exhaust pipe to remove the noxious elements from exhaust gases. Of all these devices, an exhaust emission control device of the catalyst type wherein air is supplied to the catalyst is considered to be most promising. The catalyst acts such that it converts carbon monoxide, hydrocarbons and other combustible unburnt components of exhaust gases into carbon dioxide and water vapor by self-oxidation action. A catalyst has limits to its resistance to heat on the high temperature side (700° to 800°C). When the temperature to which a catalyst is exposed exceeds this range, the catalyst burns and ceases to perform its function of purifying exhaust gases.

Carburetors of motor vehicle engines are generally set such that their exhaust emission control devices of the catalyst type exhibit the most satisfactory performance in controlling exhaust emissions at low altitude. When such engines are made to operate at high altitude, the air-fuel ratio (air volume/fuel volume) of a fuel-air mixture supplied from the carburetor to the engine is reduced because air density is reduced at high altitude. With the enriching of the fuel-air mixture, the combustible unburnt components of exhaust gases increase in amount. This tends to elevate the temperature of the catalyst because of its increased oxidation action, with the result that the catalyst burns and is rendered inoperative.

In order to prevent this trouble, motor vehicle carburetors are each generally provided with a mechanism for compensating for the effect of altitude on air density. In one type of such mechanisms of the prior art, a bellows is mounted in the upper portion of the float chamber for sensing changes in pressure and its displacement caused to occur by a change in pressure is transmitted, through a linkage or the like, to a valve disposed in the main fuel jet, so as to thereby control the flow rate of fuel. It is essential that a mechanism for compensating for the effect of altitude on air density function with a high degree of precision. The aforementioned construction of the mechanism is disadvantageous. Since the bellows is mounted in a position in which it is exposed to atmosphere, there is the danger of the bellows being subjected to the impact of vibration of the engine and vibration of the vehicle body running on a bad road. This will cause a change to occur in the characteristics of the bellows and render the catalyst inoperative in a safe temperature range.

Another disadvantage of the mechanism for compensating for the effect of altitude on air density of the prior art is that it is impossible for the mechanism to function accurately and large errors occur, because the valve mounted in the main fuel jet is operated by a relatively long link from outside the carburetor. Another disadvantage is that it is impossible to obtain a compact overall size in a carburetor when the mechanism for compensating for the effect of altitude on air density is attached to the carburetor. This will result in the carburetor taking more space than is necessary in the engine room, thereby making it impossible to install other attachments in the engine room which might otherwise be mounted therein for controlling the exhaust emission, providing means for safe driving and other purposes.

Nowadays, the high speed side and the low speed side of the engine tends to be each provided a mechanism for compensating for the effect of altitude on air density. The mounting of two bellows on one carburetor is impossible from the point of view of engine room layout.

An object of the invention is to provide a carburetor having an altitude effect compensation mechanism which is highly resistant to vibration and which shows little change in characteristics.

Another object of the invention is to provide a carburetor having an altitude effects compensation mechanism which is compact in size and capable of being assembled and installed in the carburetor without any difficulty.

The outstanding characteristic of the invention is that the altitude effects compensation mechanism comprises means for limiting the fuel flow rate disposed in fuel passage means for supplying fuel from the float chamber to induction passage means for supplying air and fuel to the engine, means adapted to be displaced by responding to changes in atmospheric pressure, and means for transmitting a displacement of such means to the flow rate limiting means, the means adapted to be displaced being immersed in the fuel in the float chamber.

Additional and other objects and features of the invention will become evident from the description set forth hereinafter when considered in conjunction with the accompanying drawings.

The invention will now be described with reference to the embodiment shown in FIG. 2.

Figure 2:
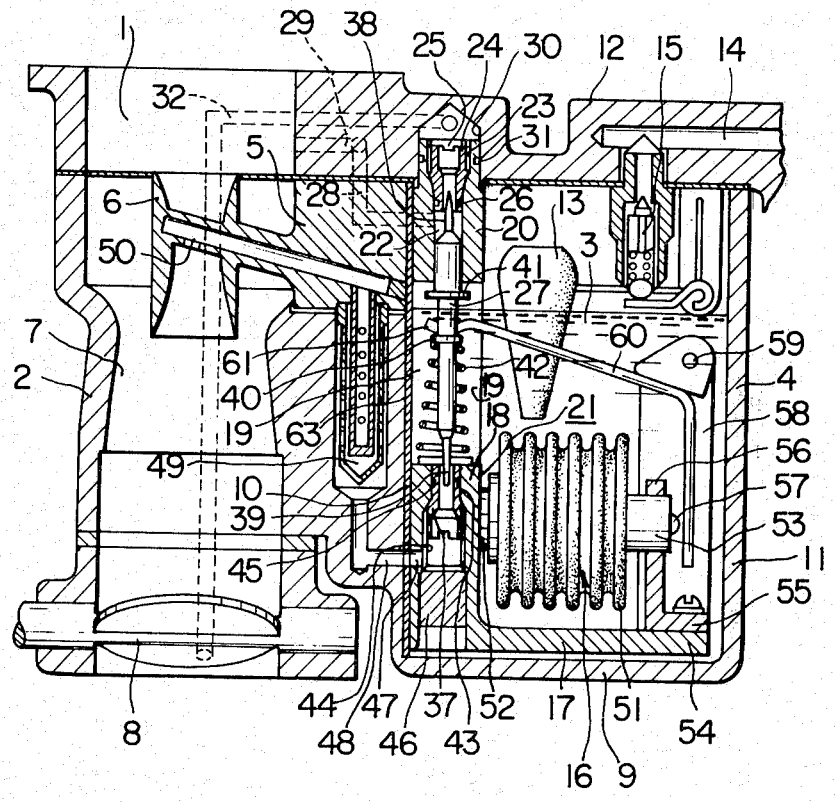
FIG. 2 is a sectional side view of a carburetor provided with the altitude effects compensation mechanism comprising one embodiment of the invention.

In FIG. 2, there is shown a carburetor provided with an altitude effects compensation mechanism which mechanism is built in the float chamber of the carburetor of the prior art. The carburetor comprises a passage body 2 formed therein with an induction passage 1 for inducing a supply of air to flow therethrough from an air cleaner (not shown) to an engine manifold (not shown) and a supply of fuel of a volume consistent with the air volume to the engine, and a chamber section 4 formed therein with a float chamber 3. Mounted within the induction passage 1 is a minor Venturi 6 disposed in the middle of the passage which is formed integral with member 5 which forms a part of the induction passage, a major Venturi 7 disposed on the downstream side of the minor Venturi 6, and a throttle valve 8 supported for pivotal movement by a shaft affixed to the passage body 2.

The float chamber 3 is defined by a bottom 9 which is substantially horizontal and rectangular in shape, a vertical side wall 10 of the passage body 2, vertical side walls 11 disposed on three sides, and a cap portion 12 disposed above the bottom 9 and shared by the passage body 2. The fuel chamber 3 contains therein fuel which is generally gasoline. Disposed in the upper portion of the float chamber is a device for maintaining a predetermined fuel level in the float chamber 3 which comprises a float 13 disposed in the fuel in the fuel chamber 3, and a valve mechanism 15 formed in the cap portion 12 and adapted to respond to the movement of the float 13 to control the rate of flow of fuel through a fuel inlet path 14 communicating with a fuel tank (not shown).

The altitude effects compensation mechanism 16 according to the invention is mounted in the fuel chamber 3 and generally extends from the central region to the lower portion of the chamber. The mechanism 16 is built in a metering body 17 formed by bending, a plate into an L shape and comprising a vertical portion 18 formed in its central portion with a cutout to provide a hollow portion 19. A guide 20 is disposed above the hollow portion 19, while a main fuel jet section 21 comprising a main fuel jet 37 and forming a part of the fuel passage is disposed below the hollow portion 19.

Formed in the guide 20 is a perpendicular aperture 22 which is contiguous with a larger aperture 23 disposed thereabove. The aperture 22 is formed therein with a threaded portion in which a low speed air jet 24 is threadably engaged. The low speed air jet 24 is formed at its top with a groove 25 for receiving the tip of a driver therein, and at its lower portion with a ring-shaped groove for fitting an O-ring 26 therein. Interposed between the lower end of the low speed air jet 24 and a portion of a needle 27 which is guided by the guide section 20 is a horizontal duct 28 which is maintained in communication with a portion of the induction passage 1 which is disposed on the upstream side of the minor Venturi 6 and on the downstream side of the air cleaner.

Figure 3:
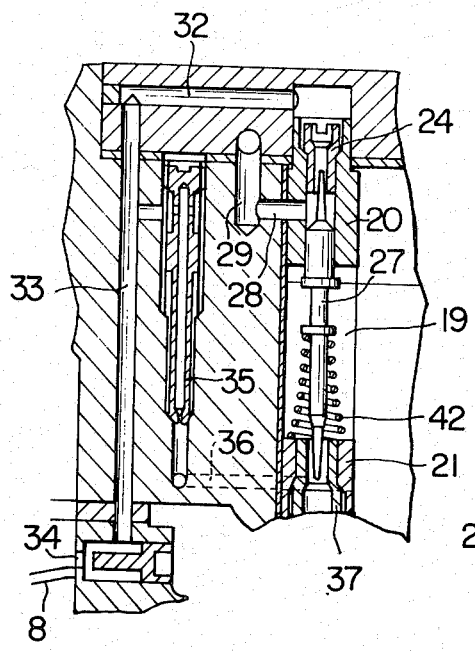
FIG. 3 is a fragmentary vertical sectional view of the essential portions of the carburetor shown in FIG. 2.

The guide 20 has an outer upper end which is inserted through a packing 31 in a hole 30 formed in the cap portion 12. The top of the outer end of the guide 20 and the cap portion 12 define therebetween a hollow space which is maintained in communication with a portion of the induction passage 1 near the throttle valve 8 through an air passage 32, low speed air passage 33 and bypass 34 formed in the passage body 2 as shown in FIG. 3. Disposed midway in the low speed fuel passage 33 is a low speed fuel jet 35 connected to a low speed fuel passage 36 which is maintained in communication with a portion of the float chamber 3 disposed below the fuel level.

The needle 27 is interposed between the low speed air jet 24 and a main fuel jet 37 and constructed such that it has opposite and portions growing smaller insize going toward the respective ends and inserted in part in the jets 24 and 37 respectively. The needle 27 is formed with a first flange 40 substantially at its central portion and a second flange 41 disposed above the first flange 40. A coil spring 42 in a compressed state is mounted between the first flange 40 and the bottom of the hollow portion 19 formed in the vertical portion 18 of the metering body 17 to urge the needle 27 to move upwardly. The second flange 41 cooperates with the bottom of the hollow portion 19 to limit the upward movement of the needle 27. The hollow portion 19 is formed at its lower portion with a vertical hole 43 which has a larger diameter lower portion threaded at 44 and which ends in a still larger diameter lowermost portion. The main fuel jet 37 is threadably inserted in the minor diameter portion and the intermediate diameter portion of the vertical hole 43 through a packing 45. The major diameter portion has fitted therein an insert 46 so as to leave no hollow space therein. Formed in the vertical hole 43 between the lower end of the main fuel jet 37 and the upper end of the insert 46 is a horizontal opening 47 connected to a main fuel passage 48 which is maintained in communication with the induction passage 1 through a main well 49 and a fuel injection port 50 formed in the minor Venturi 6.

A bellows 51, which is evacuated in the inside and disposed in the fuel in the fuel chamber 3 with its longitudinal axis being parallel to the horizontal, has a boss 52 at one end thereof which is secured as by means of screws to the vertical portion 18 of the metering body 17, and another boss 53 at the other end thereof which is slidably received for axial sliding movement in a horizontal opening 56 formed in a vertical portion of an L-shaped block 55 screwed to a horizontal portion 54 of the metering body 17. Formed on the end surface of the second boss 56 is a small spherical projection 57 which is positioned against a substantially vertical portion of a lever 60 pivotally supported by a pin 59 affixed to the upper portion of a stay 58 extending upwardly from the horizontal portion 54 of the metering body 17, the lever 60 being bent substantially at a position in which it is supported by the stay 58. The lever has an upper or forward end 61 formed such that it is maintained in line contact with the first flange 40 of the needle 27, so that the upwardly biasing force of the coil spring 42 and the axially oriented force of the bellows 51 balance through the lever 60.

In operation, when the pressure in the manifold becomes negative or sub-atmospheric and air is drawn by suction thereinto through the air cleaner, an air stream is produced in the induction passage 1. This air stream, particularly a portion of the air stream passing through the minor Venturi 6, causes fuel flow from the float chamber 3 into the air stream through the main fuel jet 37, horizontal opening 47, manifold passage 48, main well 49 and fuel injection port 50. Thus the resultant fuel-air mixture is drawn by suction into the manifold. At the same time, a negative pressure of high order is produced in a portion of the induction passage 1 which is in the vicinity of the throttle valve 8, particularly when the degree of opening of the valve 8 is large. This negative pressure caused air flow from the air passage 29 to this portion of the induction passage 1 through the low speed air jet 24, air passage 32 and low speed fuel passage 33. This air stream causes fuel flow from the float chamber 3 through the low speed fuel passage 36 and low speed fuel jet 35 to the low speed fuel passage 33 where the fuel is mixed with the air stream and drawn by suction into the manifold through the bypass 34 and induction passage 1.

When a motor vehicle runs at high altitude, the bellows 51 is expanded axially thereof due to reduced atmospheric pressure and causes the lever 60, through the projection 57, to be moved counter clockwise in pivotal movement about the pin 59. Pivoting of the lever 60 result in its forward end portion 61 moves the needle 27 downwardly against the biasing force of the coil spring 32, with the result that the main fuel jet 37 is reduced in area and the low speed air jet 24 is increased in area.

From this it will be seen that when the motor vehicle runs at high speed the fuel flow from the main fuel supply system can be adjusted according to the air density, and that when the motor vehicle runs at low speed the air flow from the low speed air jet 24 increases, so that the fuel-air mixture can be varied according to the air density. It is thus possible to provide protection to the catalyst of an exhaust emission control device of the catalyst type which is constructed such that a fuel-air mixture of a basically constant air-fuel ratio would otherwise be supplied to the engine.

When the vibration of the motor vehicle engine or the impact applied thereto is transmitted to the metering body 17, the bellows 51 will naturally vibrate because it is affixed at one end to the metering body 17 and supported at the other end by a bearing for free axial sliding movement. However, since the altitude effects compensation mechanism 16 is immersed in the fuel in the float chamber 3, the vibration of the bellows 51 is damped by the viscosity of the fuel and it merely moves slowly in the fuel.

The provision of the altitude effects compensation mechanism 16 in the vicinity of the main fuel jet 37 and the low speed air jet 24 enables to reduce the length of the lever 60 interconnecting the needle 27 inserted in the main fuel jet 37 and low speed air jet 24 and the bellows 51. This enables to obtain an overall compact size in an altitude effects compensated carburetor.

Figure 4:
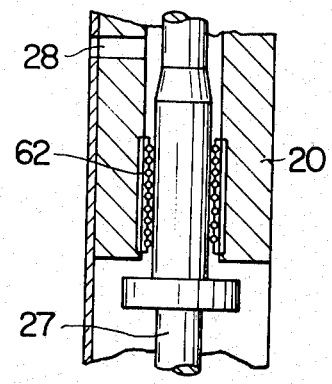
FIG. 4 is a sectional view, on an enlarged scale, of the guide for guiding the needle of the carburetor shown in FIG. 2 and FIG. 3.

As shown in FIG. 4, a linear ball bearing 62 capable of moving axially in sliding movement may be mounted in the aperture formed in the guide 20 for guiding the needle 27 thereby. This arrangement is conductive to elimination of the failure of the needle to slide or the hysteresis thereof.

The altitude effects compensation mechanism 16 comprising the metering body 17, block 55, bellows 51, lever 60, needle 27, spring 42, guide 20 main fuel jet 37 and low speed air jet 24 can be assembled as a unit and housed in a cassette for insertion in the float chamber 3 of the carburetor after adjusting the bellows 51 and lever 60 in an effort to eliminate variations in quality and prevent misoperation. This facilitates production and mounting of the mechanism.

Figure 1:
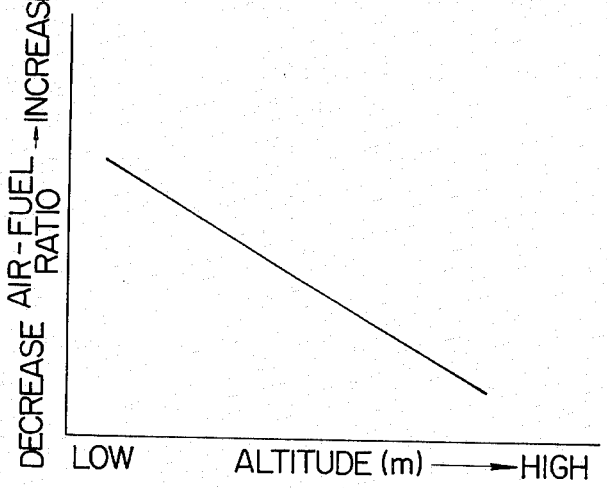
FIG. 1 is a diagram showing the relation between altitude and the air-fuel ratio of a fuel-air mixture.
Figure 5:
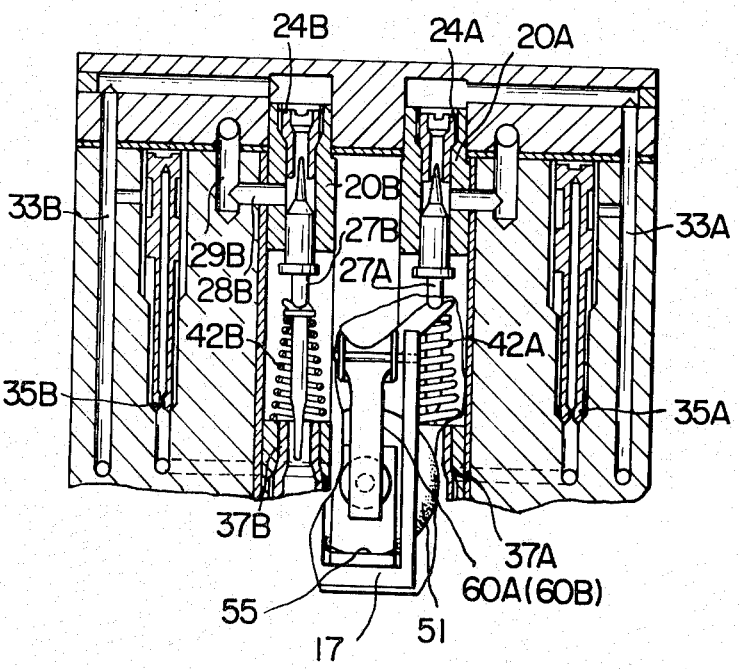
FIG. 5 is a vertical sectional view of the essential portions of a carburetor provided with the altitude effects compensation mechanism comprising another embodiment of the invention.

FIG. 5 shows the essential portions of an embodiment of the invention in which the altitude effects compensation mechanism is mounted in a duplex carburetor. In this embodiment, the low speed air jet and main fuel jet are operatively associated with each other by the same means as described with reference to the embodiment shown in FIG. 1 and FIG. 2. Two sets of mechanisms each comprising a main fuel jet and a low speed air jet are arranged symmetrically and adapted to be actuated by a single lever and a single bellows. The essential portions of the embodiments will now be described.

Figure 6:
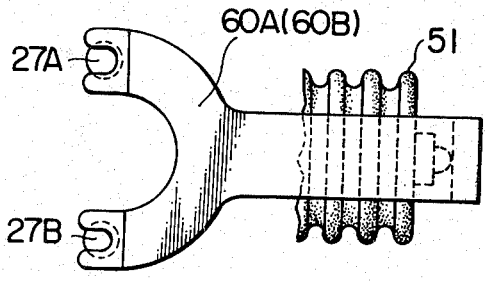
FIG. 6 is a front view of the lever shown in FIG. 5.

In the figure, 37A is a primary main fuel jet, 24A a primary low speed air jet, 35A a primary low speed fuel jet, 33A a primary low speed fuel passage, 27A a primary needle, 42A a primary spring, and 20A a primary guide. On the other hand, 37B is a secondary main fuel jet, 24B a secondary low speed air jet, 35B a secondary low speed fuel jet, 33B a secondary low speed fuel passage, 27B a secondary needle, 42B a secondary spring and 20B a secondary guide. In order to control the primary needle 27A and secondary needle 27B according to the altitude, a lever 60AB having a bifurcated end as shown in FIG. 6 is used for transmitting displacements of the bellows 51 to the primary needle 27A and secondary needle 27B. The inventiona permits the main fuel systems and low speed fuel systems on the primary and secondary sides of a duplex carburetor to be controlled simultaneously by using a single bellows. The altitude effects compensation mechanism is immersed in the fuel in the float chamber in this embodiment too.

What is claimed is:

1. An altitude effects compensated carburetor comprising an induction passage having a venturi therein and a throttle valve downstream of said venturi, a member defining said induction passage, a float chamber containing fuel therein, a metering body in said float chamber, said metering body having a substantially vertical part and a substantially horizontal part, an air jet provided in the upper portion of said vertical part, each end of which communicates with said induction passage upstream of said venturi and downstream of said venturi respectively, a main fuel jet provided in the lower portion of said vertical part of said metering body, each end of which communicates with the fuel in said float chamber and said venturi respectively, a needle for controlling opening of each of said main fuel jet and said air jet, a bellows disposed within the fuel in said float chamber, the axis of which is substantially horizontal, one end of said bellows being fixed to said vertical part of said metering body, the other end being movable along said axis according to a change of atmospheric pressure, and means for operating said needle according to the movement of the movable end of said bellows.

2. An altitude effects compensated carburetor as defined in claim 1, wherein said needle has two end portions, each diameter of which gradually decreases toward the end thereof, said each end portion forming valve means in co-operation with each of said main fuel jet and said air jet.

3. An altitude effects compensated carburetor as defined in claim 2, wherein said operating means comprises a spring exerting a force upon said needle in the axial direction and a lever transmitting the horizontal movement of said bellows to said needle.

4. An altitude effects compensated carburetor as defined in claim 3, wherein a plurality of said valve means comprising a plurality of said air jet, a plurality of said main fuel jet and a plurality of said needle are operated by said one lever and said one bellows.

5. A process of assemblying an altitude effects compensated carburetor which comprisies assembling an air jet, a main fuel jet, a spring, a lever and a bellows on a metering body, testing the assembly, inserting said assembly into a float chamber and then fixing said assembly to said float chamber.

6. An altitude effects compensated carburetor comprising an induction passage, a venturi in said passage, a throttle valve, a float chamber having a float and a valve mechanism connected with said float, a fuel passage for supplying fuel into said induction passage at said venturi, an altitude effects compensation means fully disposed in said float chamber and comprising first valve means for controlling a quantity of fuel flow to said fuel passage, bellows means fully immersed in fuel in said float chamber for making a displacement in response to changes in atmospheric pressure, valve control means for controlling said first valve means in response to the displacement of said bellows means, air passage means by-passing said venturi for introducing air from said induction passage upstream of said venturi to said induction passage in the vicinity of said throttle valve, and second valve means for controlling a quantity of air flow in said air passage means and being controlled by said valve control means, wherein said first valve means comprises a main fuel jet and a first needle, and said second valve means includes a low speed air jet and a second needle, said first and second needle being defined by end portions of a rod-shaped member which is controlled by said valve control means.

7. An altitude effects compensated carburetor as defined in claim 6, wherein said compensating means includes means fixed to said float chamber for mounting thereon said first and second valve means, said bellows means, and said valve control means.

* * * * *